US011427433B1

(12) United States Patent
Southard

(10) Patent No.: US 11,427,433 B1
(45) Date of Patent: Aug. 30, 2022

(54) PORTABLE GARDEN HOSE STAND

(71) Applicant: Liberty Garden Products, Inc., Kernersville, NC (US)

(72) Inventor: Kent Southard, Kernersville, NC (US)

(73) Assignee: Liberty Garden Products, Inc., Kernersville, NC (US)

( * ) Notice: Subject to any disclaimer, the term of this patent is extended or adjusted under 35 U.S.C. 154(b) by 0 days.

(21) Appl. No.: 17/248,948

(22) Filed: Feb. 15, 2021

Related U.S. Application Data

(60) Provisional application No. 62/980,581, filed on Feb. 24, 2020.

(51) Int. Cl.
*B65H 75/40* (2006.01)
*B65H 75/44* (2006.01)
*B65H 75/36* (2006.01)

(52) U.S. Cl.
CPC ..... *B65H 75/40* (2013.01); *B65H 75/366* (2013.01); *B65H 75/4402* (2013.01); *B65H 75/446* (2013.01); *B65H 75/4457* (2013.01); *B65H 75/4478* (2013.01); *B65H 2701/33* (2013.01); *Y10T 137/6918* (2015.04)

(58) Field of Classification Search
CPC ..... B65H 75/40; B65H 75/4402; B65H 75/4457; B65H 2701/33; B65H 75/366; B65H 75/44; B65H 75/446; B65H 75/50; B65H 75/4478; Y10T 137/6818–6962; Y10T 137/6899; Y10T 137/6918–6962
USPC ..... 137/355.27, 355.12, 355.16–355.28; 248/80, 83, 87, 85, 89–92
See application file for complete search history.

(56) References Cited

U.S. PATENT DOCUMENTS 955,260 A * 4/1910 Getman ..... B65H 75/366 248/89
2,222,831 A * 11/1940 Bitney ..... B65H 75/366 211/85.5
2,453,248 A * 11/1948 Much ..... B05B 15/625 248/75
3,029,933 A * 4/1962 Sutter ..... B65H 75/366 206/577

(Continued)

OTHER PUBLICATIONS

"Liberty Star Garden Butler" http://libertygardenproducts.com/products/sku/117, as accessed in 2016.

*Primary Examiner* — Kevin F Murphy
*Assistant Examiner* — Jonathan J Waddy
(74) *Attorney, Agent, or Firm* — MacCord Mason PLLC

(57) ABSTRACT

An improved apparatus, kit, system, and method for a portable garden hose stand is disclosed and described. In one embodiment, a portable garden hose includes a post and a butler. The post may support a garden hose in a raised position above a ground surface. The butler may be separable from the post for winding the garden hose in a hanging position upon the butler. The butler may include an attachment extending from the butler, the attachment including more than one opening, each of the more than one openings including an upper narrower slot and a lower wider slot. A primary support projection and a secondary support projection may extend from a first side of the post, and the primary support projection and the secondary support projection may mate with the more than one openings to support the butler on the post.

20 Claims, 8 Drawing Sheets

(56) References Cited

U.S. PATENT DOCUMENTS 3,309,048 A * 3/1967 Rousselet ..... B65H 75/366 248/87
D243,488 S * 3/1977 Linse ..... D8/356
4,436,267 A * 3/1984 Eads ..... B65H 75/366 248/75
4,793,376 A 12/1988 Hare
D306,681 S * 3/1990 Toca, III ..... D8/1
4,934,625 A * 6/1990 Richardson ..... B65H 75/366 242/588.2
5,109,882 A 5/1992 Eley
5,179,972 A 1/1993 Eley
D341,767 S * 11/1993 Brueske ..... D8/356
5,330,121 A 7/1994 Eley
5,375,801 A * 12/1994 Porter ..... E01F 9/631 248/156
5,462,298 A 10/1995 Bodine
5,634,615 A * 6/1997 Shuen ..... B65H 75/366 211/60.1
6,059,215 A * 5/2000 Finnis ..... B65H 75/366 242/400.1
6,079,675 A * 6/2000 Hsu ..... B65G 7/12 248/68.1
6,129,221 A * 10/2000 Shaha ..... A47B 81/00 211/87.01
D442,444 S * 5/2001 Bowling ..... D8/1
D462,254 S * 9/2002 Wright ..... B65H 75/366 D8/356
D462,603 S * 9/2002 Wright ..... B65H 75/366 D8/356
6,708,934 B2 3/2004 Brueske
6,883,537 B1 * 4/2005 Lin ..... B65H 75/36 137/355.16
D551,946 S * 10/2007 Hsu ..... D8/356
D552,971 S 10/2007 Lin
D554,979 S * 11/2007 Hsu ..... D8/356
7,377,289 B1 5/2008 English et al.
8,245,985 B2 * 8/2012 Goetz ..... B65H 75/4478 248/75
8,353,307 B2 1/2013 Blaszczak et al.
D684,035 S 6/2013 Su
D724,934 S * 3/2015 Lu ..... D8/356
D737,123 S * 8/2015 Prian ..... D8/356
D803,032 S 11/2017 Jammehdiabadi
D813,649 S 3/2018 Southard
D903,473 S * 12/2020 Peng ..... D8/356
D903,474 S * 12/2020 Peng ..... D8/356
2001/0032910 A1 * 10/2001 Brueske ..... B65H 75/366 248/80

* cited by examiner

PORTABLE GARDEN HOSE STAND

This application claims the benefit of U.S. provisional application No. 62/980,581, filed Feb. 24, 2020, which is incorporated herein by reference in its entirety.

FIELD

This disclosure relates generally to hose stands, and more specifically to portable hose stands.

BACKGROUND

Most anyone having experience with hoses, such as garden hoses or air hoses, understands some of the problems associated with the use and storage of such hoses. Storing hoses in order to avoid an unsightly mess and/or the formation of kinks that may impede flow through the hose is often difficult. It is well known that one way to address such problems is to provide a support about which the hose is wound to permit easy storage. Further, it is desirable if the support allows the hose to remain partially wound when in use, so the user does not have to unwind and rewind the entire hose each time it is used.

As a result, hose reels and carts are known in the art to wind and store unattractive, and otherwise unmanageable hoses, such as air and water hoses. Some hose reels may be modular carts, while others are wall-mounted and sonic are standing. Modular carts, while having some advantages are relatively expensive, large and bulky, requiring additional storage space, may still tangle the hose and typically are most useful when multiple faucets must be regularly accessed. Many users, however, use a hose mostly at a single faucet and do not care for the expense or bulk associated with the traditional carts.

Wall-mounted supports and hose reels are one alternative to the carts. However, many users of wall-mounted hose reels may find that the wall-mounted reels available offer very limited flexibility as to the movement of the hose by the user. Applicant finds that this limited range of motion may also cause kinks or bends in the hose that make it difficult to maneuver and/or damage the hose in the same manner that the user was trying to prevent by the use of the hose reel. Additionally, Applicant finds that existing hose stands are expensive, difficult to use, and/or problematic for the user to assemble.

It is to these and other challenges that this disclosure is directed.

SUMMARY OF THE INVENTION

The present invention is directed to a portable hose stand, including a post and a butler. The assembly allows a repositioning of the hose stand. The assembly may be a kit assembly. The inventions may include a system or method for a portable host stand.

In some examples, a portable garden hose apparatus may include a post and a butler. The post may be for positioning a garden hose in a raised position above a ground surface. The butler may be for winding a garden hose to be stored in a hanging position.

In certain embodiments, a post may include a front, a back, a first side and a second side, a top and a bottom. A post may include a front and a back. Examples may include a post having a primary support projection. The post may have a secondary support projection. The first and/or second support projection may extend outwardly away from the front of the post and include a projection end at a terminal end of the support projection.

A butler may include a frame and a guide rail. A frame may form a support portion of the butler. A guide rail may connect with the frame for guiding a garden hose onto the frame. The butler may be preassembled with a frame connected to a guide rail. The butler may include one or more openings. The butler may include two openings. The openings may be keyhole openings. The keyhole openings may include a wider lower part and a narrower upper part.

The butler may include a support center. The support center is may be curved. The support center may be curved upward between the first support end and the second support end.

In some examples, the butler slides downwardly upon the post to secure the support projection in an upper part of the keyhole opening.

Examples may include a portable garden hose stand kit, including a post and a butler. The butler may include a frame forming a support portion of the butler and a guide rail connecting with the frame. The butler may include an already assembled frame and/or an already assembled guide rail. The post and the butler may be separable. This example may include keyhole openings for accepting a projection located on the front of the post for adjoining the post and the butler.

Examples disclosed in the present disclosure are considered to include a kit, system, and/or a method by way of any of the embodiments herein.

These and other aspects of the present invention will become apparent to those skilled in the art after a reading of the following description of the preferred embodiment when considered with the drawings.

DESCRIPTION OF THE PREFERRED EMBODIMENTS

Figure 1:
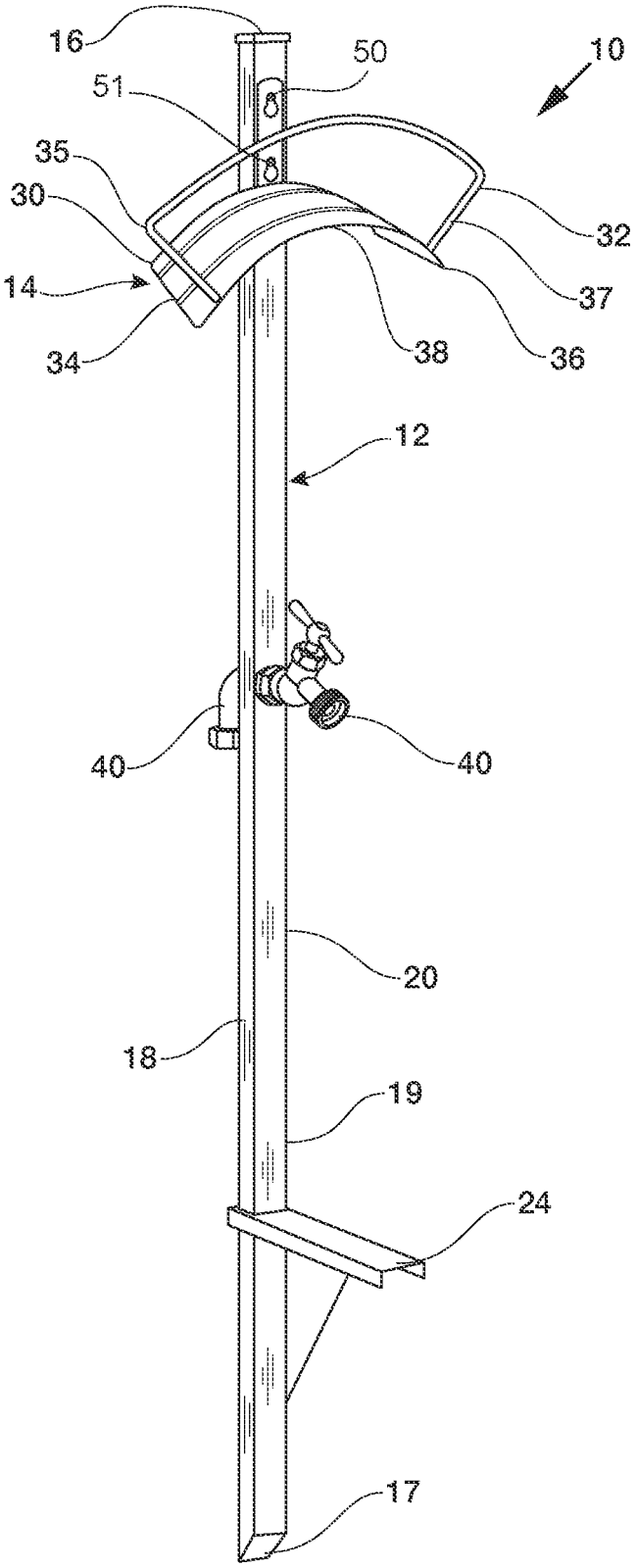
FIG. 1 is a perspective view of one example of a portable hose stand of the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general, and FIGS. 1 through 8 in particular, it will be understood that the illustrations are for the purpose of describing a preferred embodiment of the invention and are not intended to limit the invention thereto. FIG. 1 shows a hose stand 10. The hose stand 10 may be for supporting a garden hose. The hose stand 10 may include a post 12 and a butler 14.

The post 12 may include a top 16, a bottom 17, a first side 18, a second side 19, a back 21 and a front 20. The post may include a step 24 projecting horizontally from a laterally oriented post 12. The step 24 may be located close to the bottom 17 but not at the bottom 17 in some examples. The step 24 may project horizontally from the front 20 of post 12. A hose connection 40 may extend from the post 12. A hose connection 40 may be a connection to a water hose and/or to a water supply. By way of example, a hose connection 40 may extend from any side of a post 12. The connection 40 may be spaced apart from the top 16 and the bottom 17, and may occur anywhere along the length of the post. 12. The post 12 may support a water hose above a ground surface. The post 12 may attach to a butler 14, about which a water hose may be wound and secured.

Figure 7:
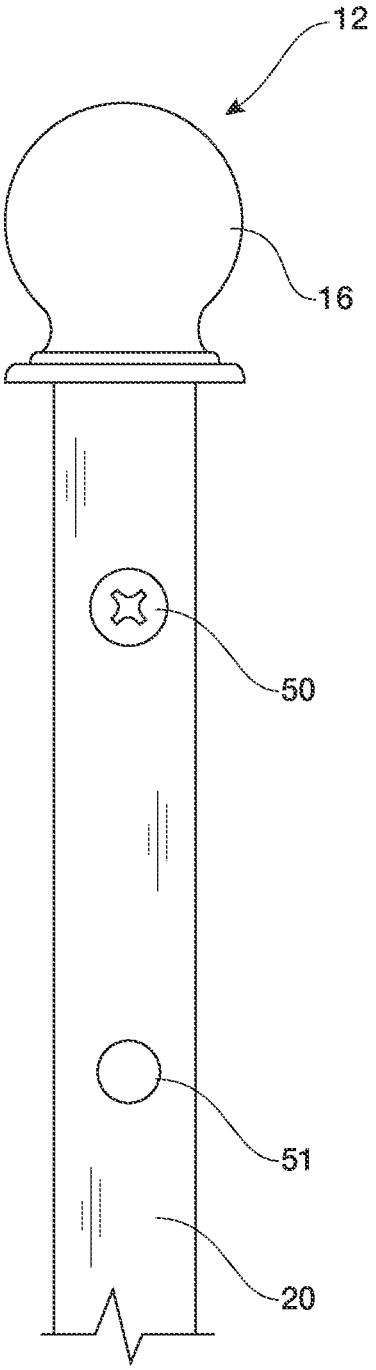
FIG. 7 shows a front view of one example of a post of a portable hose stand of the present disclosure.
Figure 8:
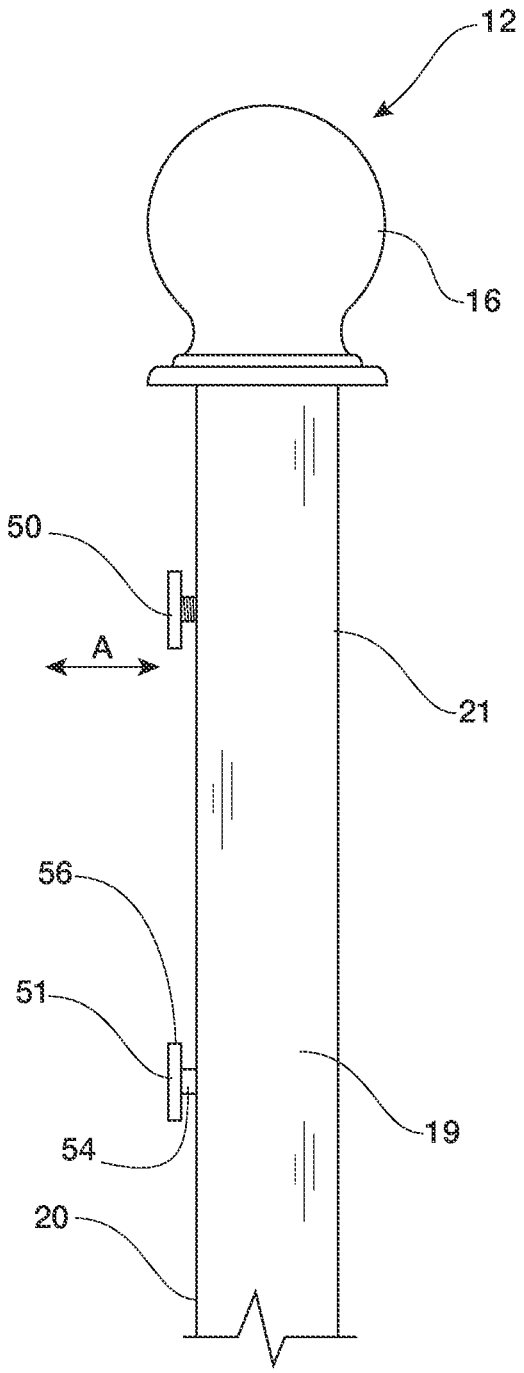
FIG. 8 show a side view of one example of a post of a portable hose stand of the present disclosure.

FIGS. 7 and 8 show a post 12, in some examples, including a primary support projection 51 and/or a secondary support projection 50. The support projections 50, 51 may include a neck and a head. The support projections may, in some examples, be integral with the post and in other examples may be detachable support, for example a screw. In certain embodiments, one of the projections may be integral and the other removable. The projections may extend from a front 20 of the post 12 toward an upper end of the post. Projections 50, 51 may both or either be removable, not removable, adjustable, and/or not adjustable.

A butler 14 may include a support 30. The support 30 may include a first support end 34, a second support end 36, and a support center 38. The butler 14 may include a guide rail 32. The support 30 may be an angled support. The support 30 may be a semi-circular shaped support. The first support end 34 and second support end 36 may be in one plane while the support center is in another raised plane. The first support end 34 may be on an opposite end from the second support end 36 of the support 30.

The butler 14 may include a guide rail 32. The guide rail 32 may attach on both sides of the support center 38. The guide rail 32 may attach along the support 30 toward the ends but before the support ends 34, 36.

Figure 2A:
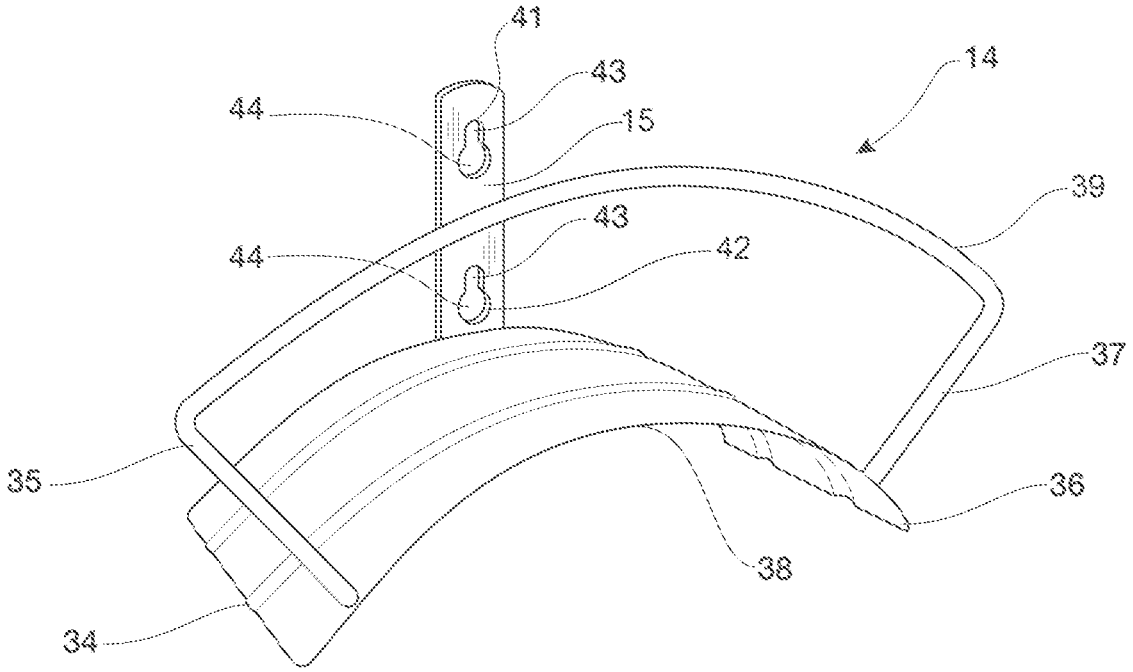
FIG. 2A-B is a perspective view of examples of a but of a portable hose stand according to FIG. 1.
Figure 2B:
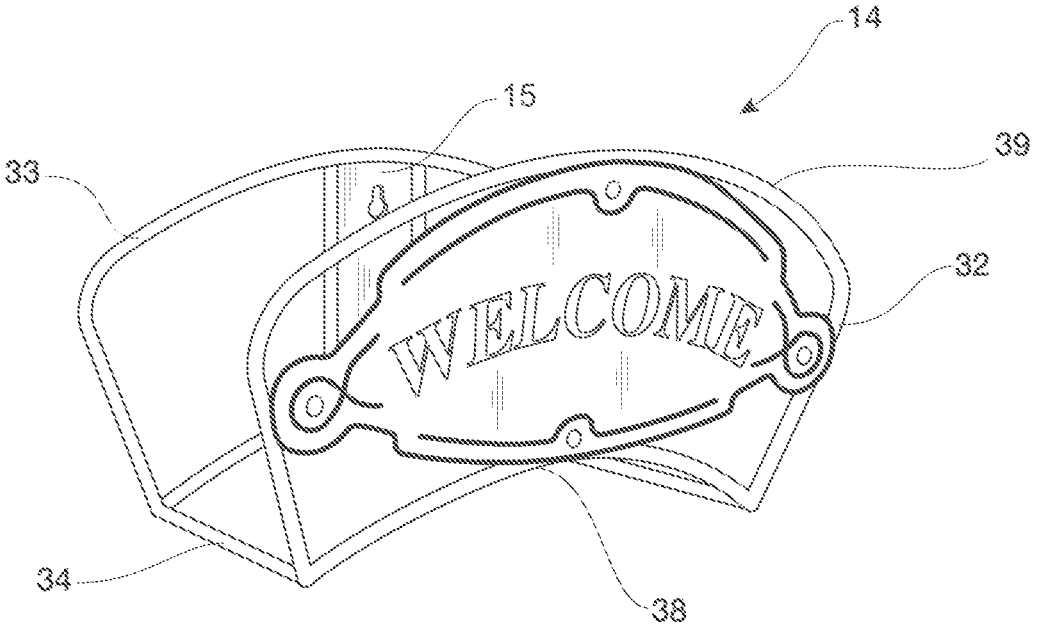
Figure 3:
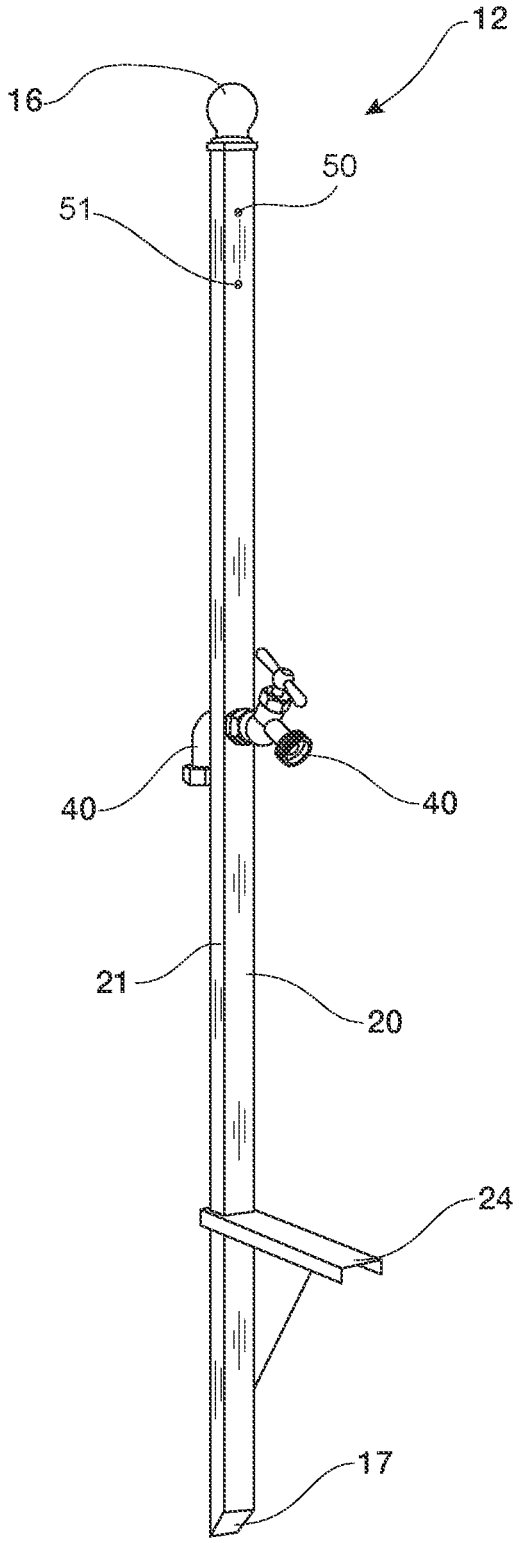
FIG. 3 is a perspective view of one example of a post of a portable hose stand according to FIG. 1.

FIGS. 2A and 2B show examples of butler 14. Butler 14 may include a back support rail 33. The support 30 may be a non-continuous support with arms forming a support frame and extending between the guide rail 32 and the back guide rail 33. The butler 12 may include side rails 35, 37 extending from the support 30 to a top rail 39. The butler may include an attachment 15 for providing an attachment point between the post 12 and the butler 14. Attachment 15 may project from support 30. Attachment 15 may attach to back rail 33 and/or support 30. Attachment 15 may include an opening 41. Opening 41 may be a first opening. Attachment 15 may include a lower opening 42. Openings 41, 42 may be keyhole openings. Openings 41, 42 may include an upper narrow slot 43 and a lower wider slot 44. The upper slot may be narrower than the lower slot and the lower slot may be wider than the narrow slot.

Figure 4:
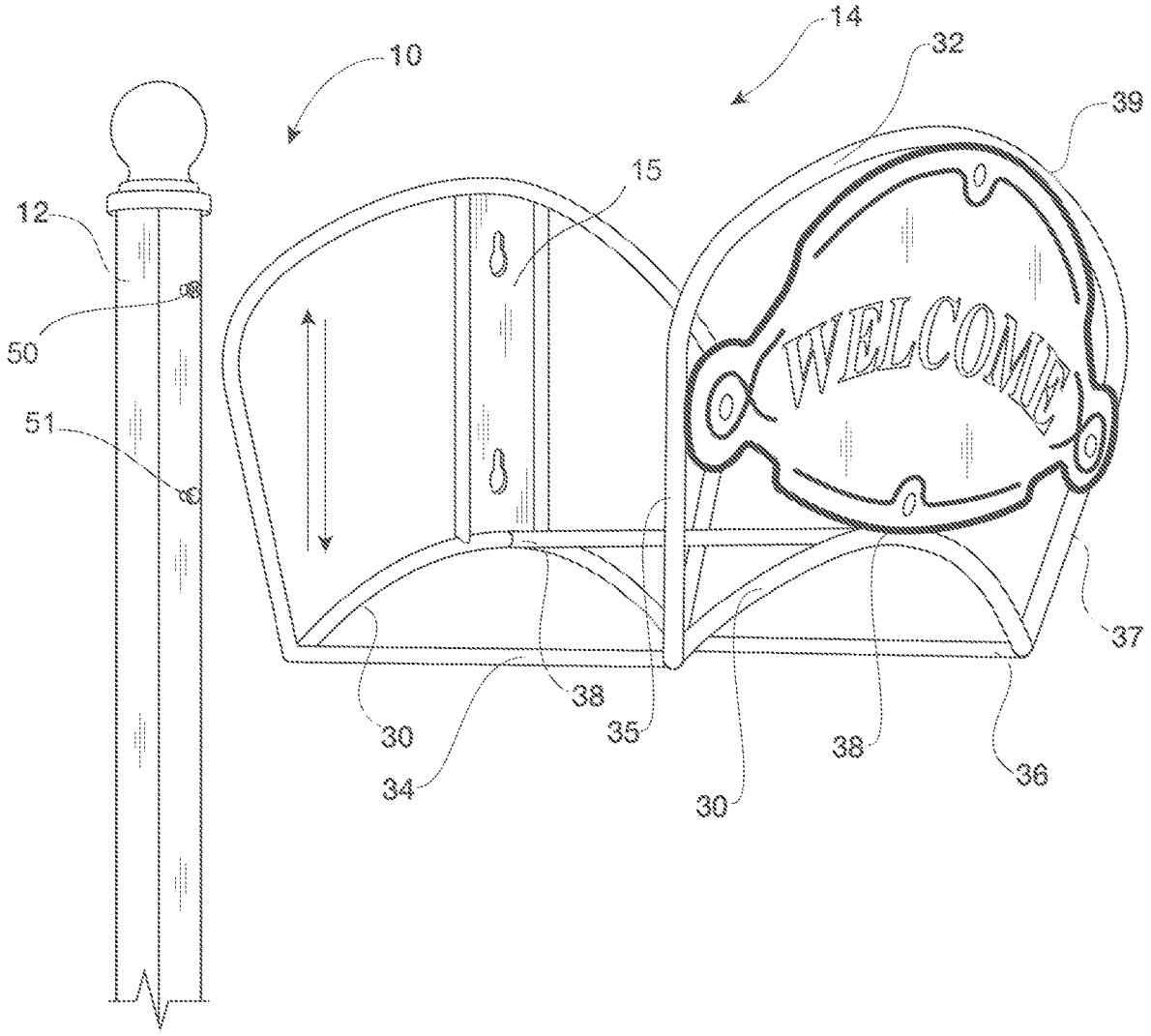
FIG. 4 is an exploded view of one example of a portable hose stand kit assembly of the present disclosure.
Figure 5:
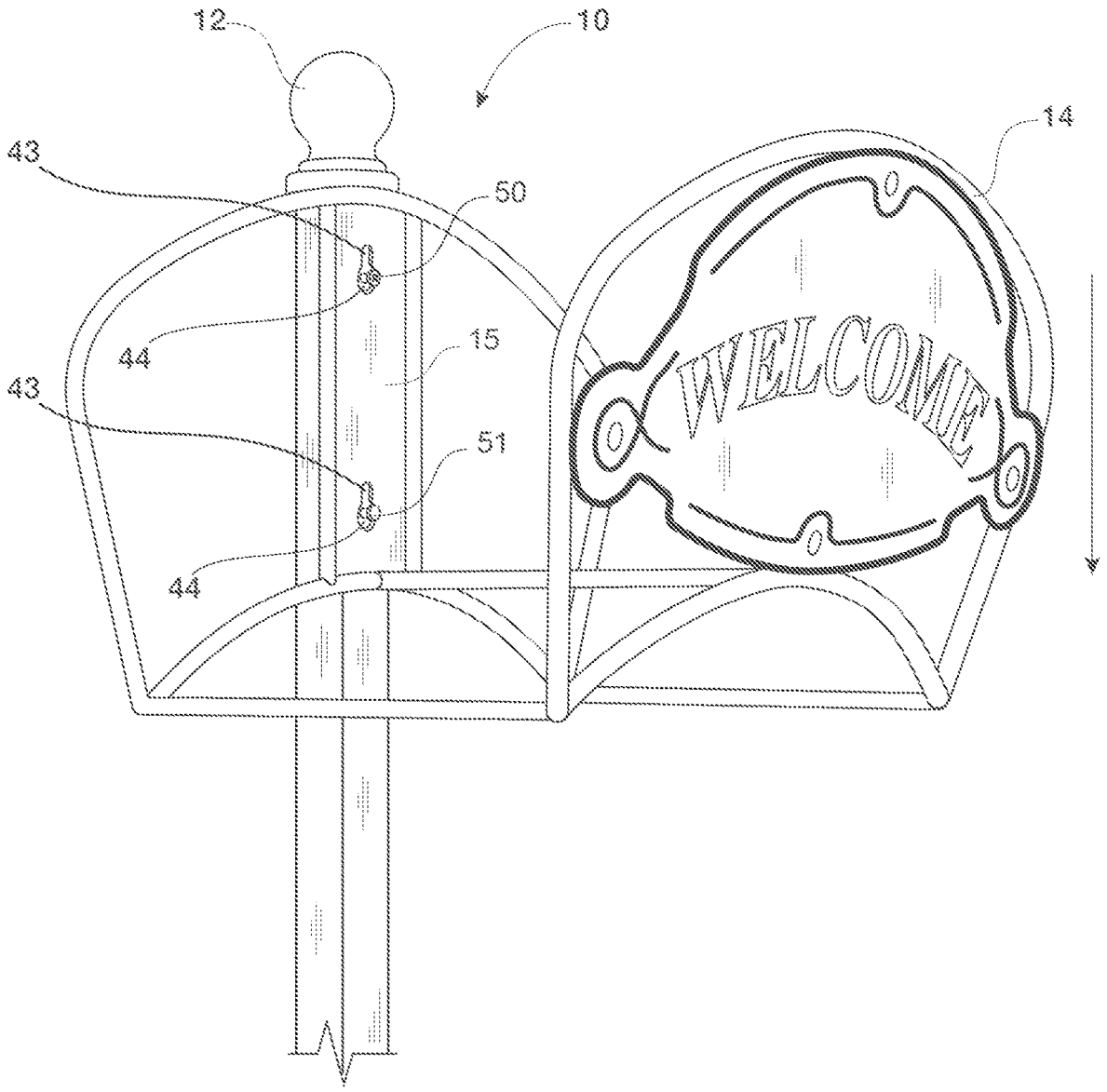
FIGS. 5-6 are assembled views of one example of the portable hose stand kit assembly of FIG. 4.
Figure 6:
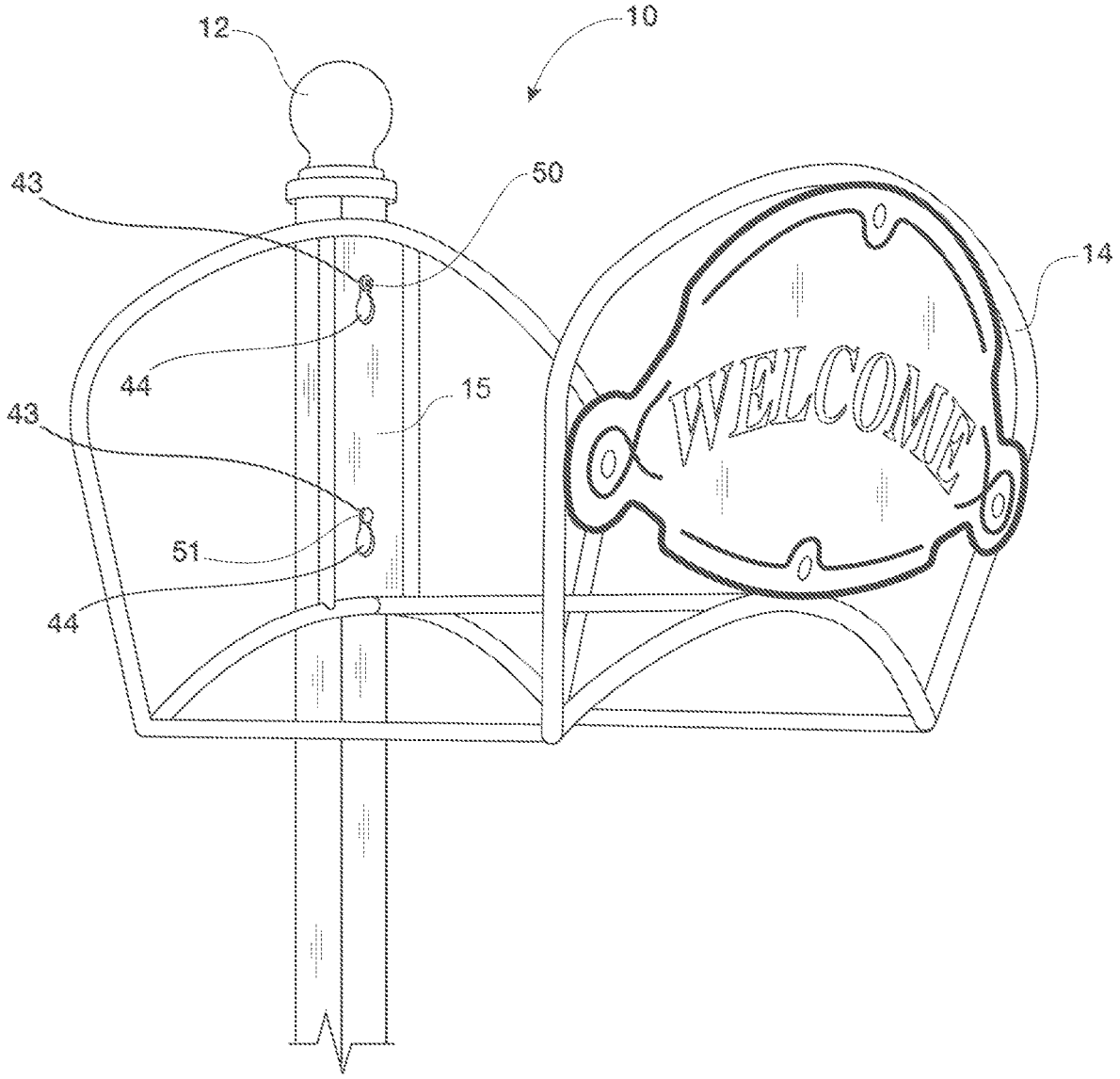

In some examples, the hose stand is a portable hose stand. The hose stand may include interchangeable parts. FIGS. 4-6 show examples of a host stand 10 in use. A butler 12 may be aligned at the openings with post projections 50, 51. The butler may slide downward along the post moving the projections 50, 51 from the lower wider slot 44 to the upper narrow slot 43. The projections 50, 51 may support the butler 12 in place. The projections 50, 51 may each or either be tightened to secure the butler 12 in place. The projections 50, 51 may extend outwardly along a center line of the post 12. The projection 50, 51 may either or both be integral with the post so that it is unable to be removed from the post 12. In certain examples, a projection 50 may be immovable to support the butler 14, while the other projection 51 may be tightened against the butler to secure it to the post 12, and vice versa.

The inventions include a kit for a portable hose stand 10. The kit may include a post 12 separable from a butler 14 and removably connected to allow for interchanging with another post for the post 12 and/or another butler for the butler 14. The butler may be removed by an upward movement to release the openings 41, 42 from the projections 50, 51. This allows for interchange of parts when damaged without replacement of the entire hose stand 10 and also allows for the post 12 and butler 14 to be separated in case of garden hose adjustment or movement of the portable host stand 10 from one location to another. The kit may include a mix and match post 12 and butler 14. The kit may provide for a space savings by the ability to remove the butler 14 from the post 12 for shipping and for storage and display. The ease of assembly provides a more easily adjusted and assembled hose stand for a consumer.

In certain examples, the post 12 may take on different shapes and geometries, for example, the post may be a circular post. The butler 14 may take on different shapes and geometries, by way of example, and may be rounded, oval shaped, squared, rectangular or irregular shaped. The butler may be supported by the post in the air and the butler, in turn suspends a garden hose in the air.

Certain modifications and improvements will occur to those skilled in the art upon a reading of the foregoing description. A method for a hose stand and a hose stand kit are considered within the scope of this disclosure. It should be understood that all such modifications and improvements have been deleted herein for the sake of conciseness and readability but are properly within the scope of this disclosure.

I claim:

1. A method for hanging a portable garden hose via a portable and self-supporting stand comprising:

forming a post having a set of projections, wherein one of the set of projections is stationary and integrally formed with the post;

forming a separate butler having a set of keyhole openings;

matching the set of projections to the size of an upper part of the keyhole openings for mating the projections with the openings;

stabilizing one of the projections of the set of projections to be stationary;

maintaining one of the projections of the set of projections to be adjustable to secure the butler to the post; and providing a surface along the butler for winding a garden hose about the surface to suspend the garden hose above a ground surface.

2. The method of claim 1 including maintaining a separability of the butler from the post.

3. The method of claim 2 wherein the butler is removable from the post by moving the butler upward so that the set of projections slides from the upper part of the keyhole openings to a lower part of the keyhole openings wherein the set of projections are removable from the keyhole openings.

4. A self-standing portable garden hose stand kit, comprising:

a post for positioning a garden hose in a raised position above a ground surface, a butler for winding the garden hose in a hanging position above the ground surface, a frame forming a support portion of the butler, and a guide rail connecting with the frame, wherein said post and said butler are separable, and said butler includes a set of keyhole openings for accepting a set of projections located on a front of the post for adjoining the post and the butler, wherein at least one of the projections is integrally formed with the post.

5. The kit of claim 4 wherein said butler slides into the hanging position on the post to engage the set of projections and the set of keyhole openings to form a standing portable garden hose position.

6. The kit of claim 5 wherein at least one of said set of projections is stationary.

7. The kit of claim 6 wherein at least one of said set of projections is adjustable.

8. The kit of claim 7 wherein said adjustable projection is adapted to be tightened after the post and butler are mated to secure the butler to the post.

9. A self-supporting, portable garden hose apparatus, comprising:

a post for supporting a garden hose in a raised position above a ground surface, a butler separable from the post for winding the garden hose in a hanging position upon the butler, a frame forming a support portion of the butler, a guide rail connecting with the frame for guiding the garden hose onto the frame, an attachment extending from the butler, the attachment including more than one opening, each of the more than one openings including an upper narrower slot and a lower wider slot, the two slots joining to form the entirety of each opening, a primary support projection and a secondary support projection extending from a front side of the post, wherein at least one of the projections is integrally formed with the post, and wherein said primary support projection and said secondary support projection mate with the more than one openings to support the butler on the post.

10. The apparatus of claim 9, wherein the post incudes a top, a bottom, and the front side and a second side.

11. The apparatus of claim 10, wherein the butler attaches to the post on the front side to support the butler in the hanging position.

12. The apparatus of claim 11, wherein the butler includes a first support end and a second support end.

13. The apparatus of claim 12 wherein the butler includes a support center.

14. The apparatus of claim 13 wherein the support center is curved.

15. The apparatus of claim 14 wherein the support center is curved upward between the first support end and the second support end.

16. The apparatus of claim 15 wherein the primary support projection is adjustable.

17. The apparatus of claim 16 wherein the secondary support projection is stationary.

18. The apparatus of claim 16 wherein said secondary support projection extends outwardly away from the front side of the post and includes a projection end at a terminal end of the secondary support projection.

19. The apparatus of claim 18 wherein said each of the more than one openings are keyhole openings for accepting one of the two support projections in the lower wider slot of the keyhole openings.

20. The apparatus of claim 19 wherein said butler slides downwardly upon the post to secure the support projection in the upper narrower slot of the keyhole opening.

* * * * *